US012097999B2

(12) United States Patent
Ciccone et al.

(10) Patent No.: US 12,097,999 B2
(45) Date of Patent: Sep. 24, 2024

(54) DOUBLE LOCK LID WITH FLEXIBLE TAB

(71) Applicant: Top Grade Molds Ltd., Mississauga (CA)

(72) Inventors: Vincenzo Ciccone, Kleinburg (CA); Jerko Knezovic, Brampton (CA); Petrica Maran, Mississauga (CA); Deddy Darmawan, Bandung (ID)

(73) Assignee: Top Grade Molds Ltd., Mississauga (CA)

( * ) Notice: Subject to any disclaimer, the term of this patent is extended or adjusted under 35 U.S.C. 154(b) by 15 days.

(21) Appl. No.: 17/923,796

(22) PCT Filed: May 6, 2021

(86) PCT No.: PCT/CA2021/050638
§ 371 (c)(1),
(2) Date: Nov. 7, 2022

(87) PCT Pub. No.: WO2021/223033
PCT Pub. Date: Nov. 11, 2021

(65) Prior Publication Data

US 2023/0202722 A1 Jun. 29, 2023

Related U.S. Application Data

(60) Provisional application No. 63/021,346, filed on May 7, 2020.

(51) Int. Cl.

| | |
|---|---|
| ***B65D 43/02*** | (2006.01) |
| ***B65D 43/06*** | (2006.01) |
| ***B65D 55/06*** | (2006.01) |

(52) U.S. Cl.
CPC ..... *B65D 43/0249* (2013.01); *B65D 43/065* (2013.01); *B65D 55/06* (2013.01); *B65D 2543/00092* (2013.01); *B65D 2543/00296* (2013.01)

(58) Field of Classification Search
CPC .. B65D 43/0249; B65D 43/065; B65D 55/06; B65D 2543/00092; B65D 2543/00296
USPC ..... 220/266
See application file for complete search history.

(56) References Cited

U.S. PATENT DOCUMENTS

| | | | |
|---|---|---|---|
| 2,296,599 | A | 9/1942 | Costello |
| 3,860,141 | A | 1/1975 | Hawk |
| 4,385,708 | A | 5/1983 | Curry |
| 4,625,876 | A | 12/1986 | Bullock |

(Continued)

FOREIGN PATENT DOCUMENTS

| | | |
|---|---|---|
| CA | 2163306 | 5/1997 |
| DE | 4321649 A1 | 1/1995 |

(Continued)

*Primary Examiner* — J. Gregory Pickett
*Assistant Examiner* — Niki M Eloshway
(74) *Attorney, Agent, or Firm* — Smart & Biggar LP

(57) ABSTRACT

A container system including a lid and a container is provided. A locking structure on the skirt of the lid is situated on a tear off portion and comprises a plurality of flexible tabs positionable in an upwardly biased locked position each independently engaging the container within an annular cut away on the container wall below a locking rib. If the lid is removed with tear off strip still engaged, the flexible tabs are biased downwardly and may break off, exposing tampering.

16 Claims, 8 Drawing Sheets

(56) References Cited

U.S. PATENT DOCUMENTS

| | | | | |
|---|---|---|---|---|
| 4,711,364 | A | 12/1987 | Letica | |
| 4,735,337 | A | 4/1988 | Von Holdt | |
| 4,881,656 | A | 11/1989 | Chumley et al. | |
| 4,930,656 | A | 6/1990 | Blanchette | |
| 4,971,220 | A | 11/1990 | Kaufman et al. | |
| 5,046,632 | A | 9/1991 | Bordner | |
| 5,065,887 | A | 11/1991 | Schuh et al. | |
| 5,238,135 | A | 8/1993 | Landis | |
| 5,294,015 | A | 3/1994 | Landis | |
| 5,366,104 | A | 11/1994 | Armstrong | |
| 5,395,003 | A | 3/1995 | Matsuda | |
| 5,538,154 | A | 7/1996 | Von Holdt | |
| 5,540,349 | A | 7/1996 | Philips | |
| 5,626,251 | A | 5/1997 | Luburic et al. | |
| 5,730,309 | A * | 3/1998 | Jiradejnunt | A47J 47/18 215/354 |
| 5,873,482 | A * | 2/1999 | Conti | B65D 25/32 220/268 |
| 5,873,484 | A * | 2/1999 | Clute | B65D 43/0256 220/276 |
| 6,068,151 | A | 5/2000 | Recendez | |
| 6,279,774 | B1 * | 8/2001 | Clute | B65D 43/0256 220/780 |
| 6,543,635 | B2 | 4/2003 | Ciccone | |
| 6,619,498 | B2 | 9/2003 | von Holdt, Jr. | |
| 6,688,483 | B2 | 2/2004 | Davis | |
| 6,779,676 | B2 | 8/2004 | Ciccone | |
| 7,063,230 | B2 | 6/2006 | Ciccone | |
| 7,090,088 | B2 * | 8/2006 | von Holdt, Jr. | B65D 21/0219 220/276 |
| 2004/0045966 | A1 * | 3/2004 | Von Holdt, Jr. | B65D 43/0256 220/276 |
| 2004/0079757 | A1 | 4/2004 | Ciccone | |
| 2005/0269339 | A1 * | 12/2005 | Ciccone | B65D 43/0258 220/795 |
| 2006/0163265 | A1 * | 7/2006 | De Candido | B29C 45/4407 220/784 |
| 2007/0102438 | A1 * | 5/2007 | Schwarz | B65D 43/0237 220/276 |
| 2009/0026203 | A1 * | 1/2009 | Selina | B65D 43/0256 220/276 |
| 2010/0181314 | A1 * | 7/2010 | Renda | B65D 43/0256 220/266 |
| 2012/0029323 | A1 | 11/2012 | Young | |
| 2012/0292323 | A1 | 11/2012 | Young | |

FOREIGN PATENT DOCUMENTS

| | | | | |
|---|---|---|---|---|
| EP | 0052172 | A1 | 5/1982 | |
| EP | 0723918 | A1 | 7/1996 | |
| FR | 2103410 | A1 | 4/1972 | |
| GB | 450087 | | 7/1936 | |
| WO | 02074633 | A2 | 9/2002 | |
| WO | 2002074633 | A2 | 9/2002 | |
| WO | WO-2019111060 | A1 * | 6/2019 | B65D 43/0206 |

* cited by examiner

DOUBLE LOCK LID WITH FLEXIBLE TAB

TECHNICAL FIELD

This disclosure relates generally to containers, and particularly to a double locking container system having a robust tamper proofing that will prevent for example a paint can or other similar container from being opened and re-sealed without any observable indication that the container has been tampered with.

BACKGROUND

Containers with lids that can be secured in place upon the container and having tamper-evident features are known.

Conventional tamper evident sealing involves an annular sealing bead that is designed such that it must be broken before the lid of a container can be removed, thus indicating that the container had been previously opened. Known solutions are not very effective however as they can often be opened without damaging the seal by using a sharp object to pry open the annular bead. Furthermore, the annular beads of known containers offer no improvement to the container's performance on any of the typical quality tests for containers, such as drop tests, leak tests mentioned below. The features also conventionally require intricate molding geometries that are difficult to effectively cool, making them challenging to mold into a part.

U.S. Pat. No. 5,249,694 discloses a lid and a container that cooperate to form a double lock. The lid comprises a skirt that comprises a ridge on the exterior wall of the skirt and a ridge on the interior wall of the skirt. The cup comprises a ridge on its exterior wall and a flange that extends outwardly from the exterior wall and the flange comprising an inner ridge. The ridges of the skirt cooperates with the ridges of the cup to form two seals. The flange of the cup is a tear strip.

U.S. Pat. No. 5,437,386 discloses a container that comprises a double wall. The inner wall has an outwardly projecting rib and the outer wall has an inwardly projecting rib. The lid comprises a peripheral portion that has an inwardly projecting rib that engages the outwardly projecting rib of the container. The end of the peripheral portion engages the inwardly projecting rib of the container. The outer wall of the container needs to be folded outwardly to allow the lid to be removed.

Accordingly, there is a need for a container system that has an effective locking system for a lid with reduced material, simplified manufacturing and improved tamper-evident features.

SUMMARY OF THE INVENTION

In accordance with one aspect of the invention, a lid for a container is provided. The container has a peripheral side wall with a rim, the rim having upper and lower peripheral, annular outwardly disposed locking beads (also referred to as flanges), said beads having undersides for locking engagement with the container lid, the lid comprising: a central portion and a peripheral annular skirt adapted to overlie the container locking beads; the annular skirt defining an annular groove dividing said skirt into a skirt upper portion and a skirt lower portion; the skirt lower portion having a plurality of inwardly disposed flexible locking tabs/teeth adapted to each independently engage the underside of the container lower locking flange when said lid is positioned on said container in a locked position.

In accordance with a further aspect of the invention, the skirt lower portion forms a tear-off strip portion having a lower peripheral edge, and wherein the tear-off strip portion is formed with a circumferential reduced thickness portion located below the skirt upper portion, facilitating removal of the tear off strip.

In one aspect of the invention, the lid and the container form a sealing arrangement.

In one aspect, the tearing of the tearable portion is required to remove the lid. The tearing of the tearable portion and/or the separation of some of the flexible tabs/teeth during lid removal if the tearable portion remains on the lid during removal, serve as evidence of tampering.

BRIEF DESCRIPTION OF THE DRAWINGS

Reference will now be made, by way of example, to the accompanying drawings which show example embodiments of the present application, and in which.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION OF THE INVENTION

In various examples, the present disclosure describes a container system in which the lid and container forms a double tamper evident lock, comprising at least one ring of flexible tabs positioned on the lid, adapted to engage the container in locking engagement. Although the present disclosure provides examples, the disclosed methods and devices may be suitable for other purposes, with modification as appropriate.

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprising" as used herein will be understood to mean that the list following is non-exhaustive and may or may not include any other additional suitable items, for example one or more further feature(s), component(s) and/or ingredient(s) as appropriate.

Figure 1:
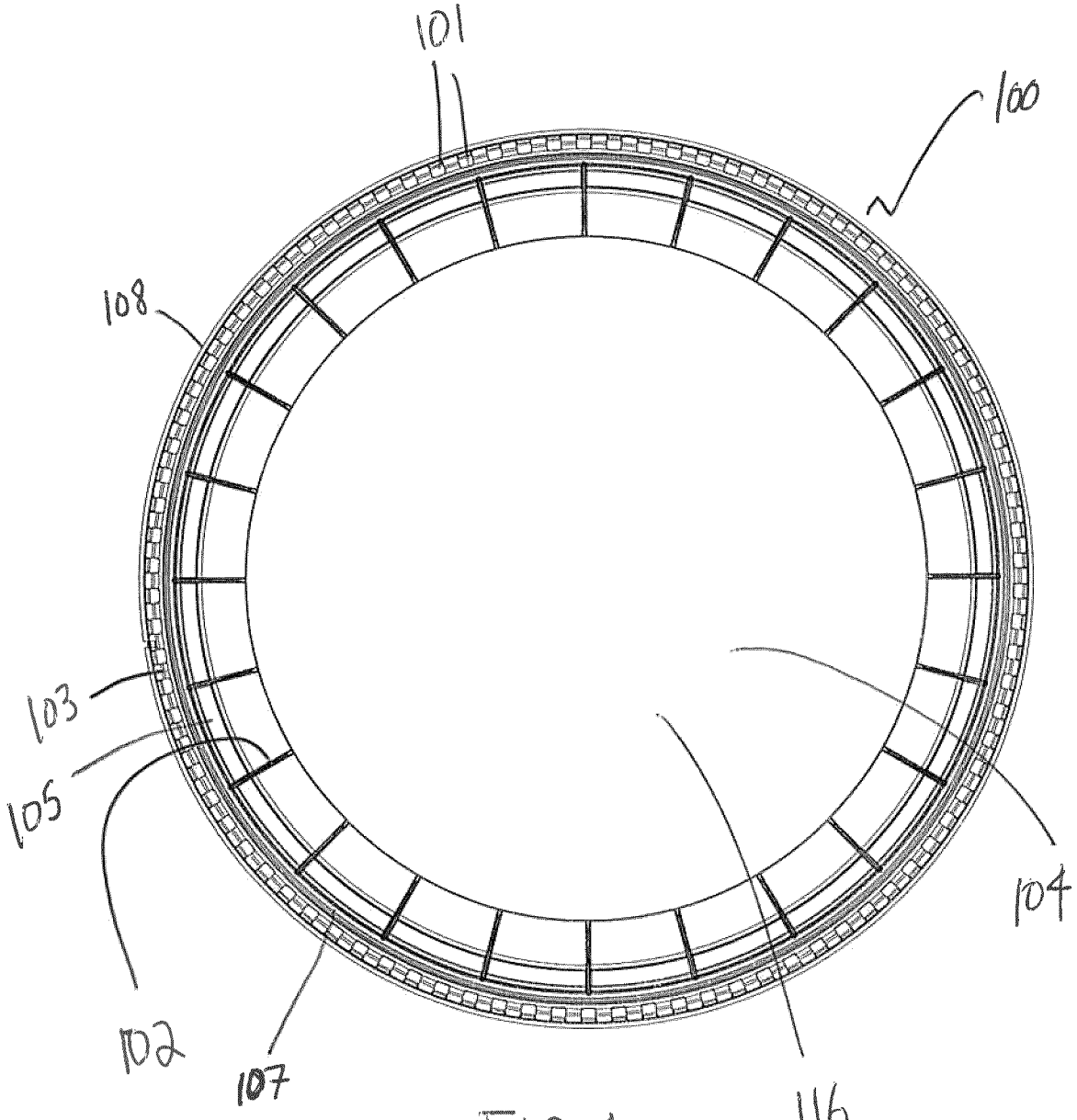
FIG. 1 shows a bottom view of the lid.

Reference is now made to FIG. 1, which shows a bottom view of the lid 100.

In some embodiments, the lid 100 is circular, as shown in FIG. 1. In some embodiments, the lid is rectangular, square, elliptical, parallelogram, or any other suitable shape for a lid.

Figure 2:
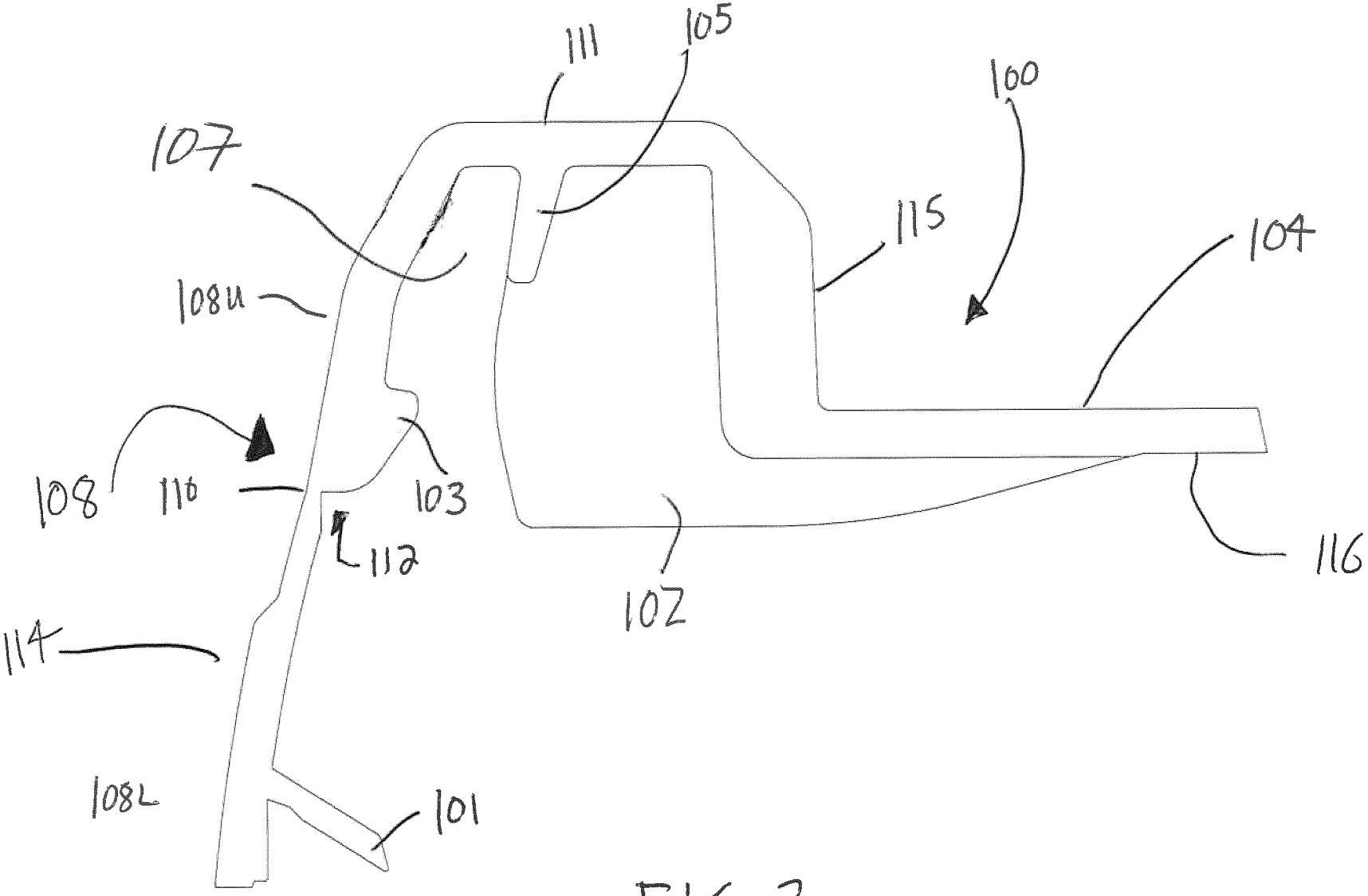
FIG. 2 shows a close up sectional view of the periphery of the lid.

As can be seen in FIGS. 1 to 3A, in some embodiments, the lid 100 has a peripheral skirt 108 extending downwardly from a position close to the outer edge of the lid 100. In some embodiments, the skirt 108 extends from the outer edge of the lid 100. In some embodiments, the skirt 108 is configured offset from the outer edge of the lid 100 such that the outer periphery of the lid 100 may be used for holding the lid 100. In some embodiments, one or more strengthening rib 102 is provided on the underside 116 of the lid 100, as shown in FIGS. 1 and 2. In some embodiments, the rib 102 extends from a central portion of the lid 100 toward the outer edge of the lid 100. In some embodiments, a gap 107 is formed between the rib 102 and the skirt 108. In some embodiments, a ridge 105 is provided at the end of the strengthening ribs 102 facing the skirt 108, the ridge 105 extending downwardly from the underside 116 of the lid 100. In some embodiments, the ridge 105 does not extend as far from the underside 116 of the lid 100 as the strengthening rib 102. In some embodiments, the ridge 105 circumferentially connects the outer ends of the strengthening ribs 102, forming a closed loop. In some embodiments, a circumferential ridge 103 is provided on the interior surface of the skirt 108, and the circumferential ridge/flange 103 extends inwardly from the interior surface of the skirt 108. As shown in the Figures, a lid 100 for a container is provided. The container 200 has a peripheral side wall with a rim, said rim having upper and lower peripheral, annular outwardly disposed locking flanges 204, 201, said flanges having undersides for locking engagement with the container lid. The lid comprises a central portion and a peripheral annular skirt 108 adapted to overlie the container locking flanges 204, 201. The annular skirt 108 defining an annular groove 110 dividing said skirt into a skirt upper portion 108U located adjacent to the container upper locking flange, and a lower portion 108L located adjacent to the container lower locking flange; the skirt upper portion having an inwardly disposed locking flange 103 adapted to engage the underside of the container upper locking flange 204 in snap fit engagement, the skirt lower portion having a plurality of inwardly disposed flexible locking tabs 101 adapted to engage the underside of the container lower locking flange 201 when said lid is positioned on said container in a locked position.

In the example embodiment shown, the skirt lower portion forms a tear-off strip portion 114 having a lower peripheral edge, and wherein the tear-off strip portion is formed with a circumferential reduced thickness portion 110 (also referred to as annular groove) located between the skirt upper portion and skirt lower portion, facilitating removal of the tear off strip 114. In some embodiments, the weakened area is a weakened line 110 as shown in FIG. 2. In some embodiments, such as shown in FIG. 3A, the tearable portion 114 includes a pulling portion 109 that is configured to facilitate pulling the tearable portion 114 off the lid 100. For example, the pulling portion 109 may be provided with a rough surface to increase friction when it is being pulled. In some embodiments, the weakened line 110 extends along a portion of the flange. In some embodiments, the weakened line 110 extends along the full circumference of the skirt 108. In some embodiments, the weakened area comprises a weakened line that extends downwardly to the lower edge 113 of the skirt 108.

The lid may further comprise an annular sealing groove 107 located between the lid central portion and the peripheral annular skirt, the sealing groove being adopted to sealingly engage the rim of the container.

In the embodiment of the invention shown in the drawings, a tamper-evident feature is incorporated including a series of foldable locking tabs (also referred to as teeth) on the lid in place of the single annular locking bead known in the art. This incorporates multiple discontinuous contact locking areas that would be very difficult to pry open without damaging the container. Further, if each feature is independently connecting the lid and the pail, the force connecting the two parts will be increased and less susceptible to damage. If one tab feature is disconnected it won't impact the other features' ability to grip the lid. To achieve an effective seal each individual feature (each tooth/tab) must effectively grip the container.

In the example embodiment, the design consists of a ring of interconnected, small, rectangular tabs 101 that protrude from the lid 100 at a downward angle when lid is not engaged on container, shown in FIG. 2. As lid is pressed on top of a container, as will be described in detail, each tab 101 engages a mating feature on the container wall. Each tab grips under a mating feature in the container that in an example embodiment consists of a locking ridge 201 and a radial undercut 520 shown in FIGS. 3 and 3*a*. The container includes a tamper reducing ridge 202 feature that would encompass the bottom skirt feature of the lid engaging a ridge of the container to complete the tamper-evident seal. Details of these feature will be discussed below.

In an example embodiment, a plurality of flexible tabs/teeth 101 are provided along the circumference of the interior surface of the skirt 108 of the lid. The tabs 101 are disposed between the circumferential upper locking flange 103 and the lower edge 113 of the skirt 108. The tabs 101 are separate from each other, connected only by the interior surface of the skirt 108. In some embodiments, there is a ridge (not shown) running at the roots of the tabs 101 along the circumference of the interior surface of the skirt 108, connecting the tabs 101. In some embodiments, a flexible ring is provided in place of or in addition to the flexible tabs 101. By using a plurality of individual tabs 101 instead of a ridge, a saving in plastic is realized. In addition, the individual tabs 101 may provide individual locking contact on the container that cannot be easily tampered. The example embodiment of the invention shown is a container and lid combination that will incorporate a ring of roughly 100 foldable locking teeth on the lid to engage the container to provide tamper-evident sealing and improve part performance.

An example embodiment of the invention is designed to pass a part drop test (the part must withstand a 1.2 m drop without signs of leakage), vibration test (the part is shaken and cannot show signs of leakage), and leak proof test (the part is submerged under water and cannot show signs of leakage) requirements to ensure improved lid-to-container engagement. The example embodiment described with the below specifications passed the above noted drop, vibration and leak proof tests.

Figure 3:
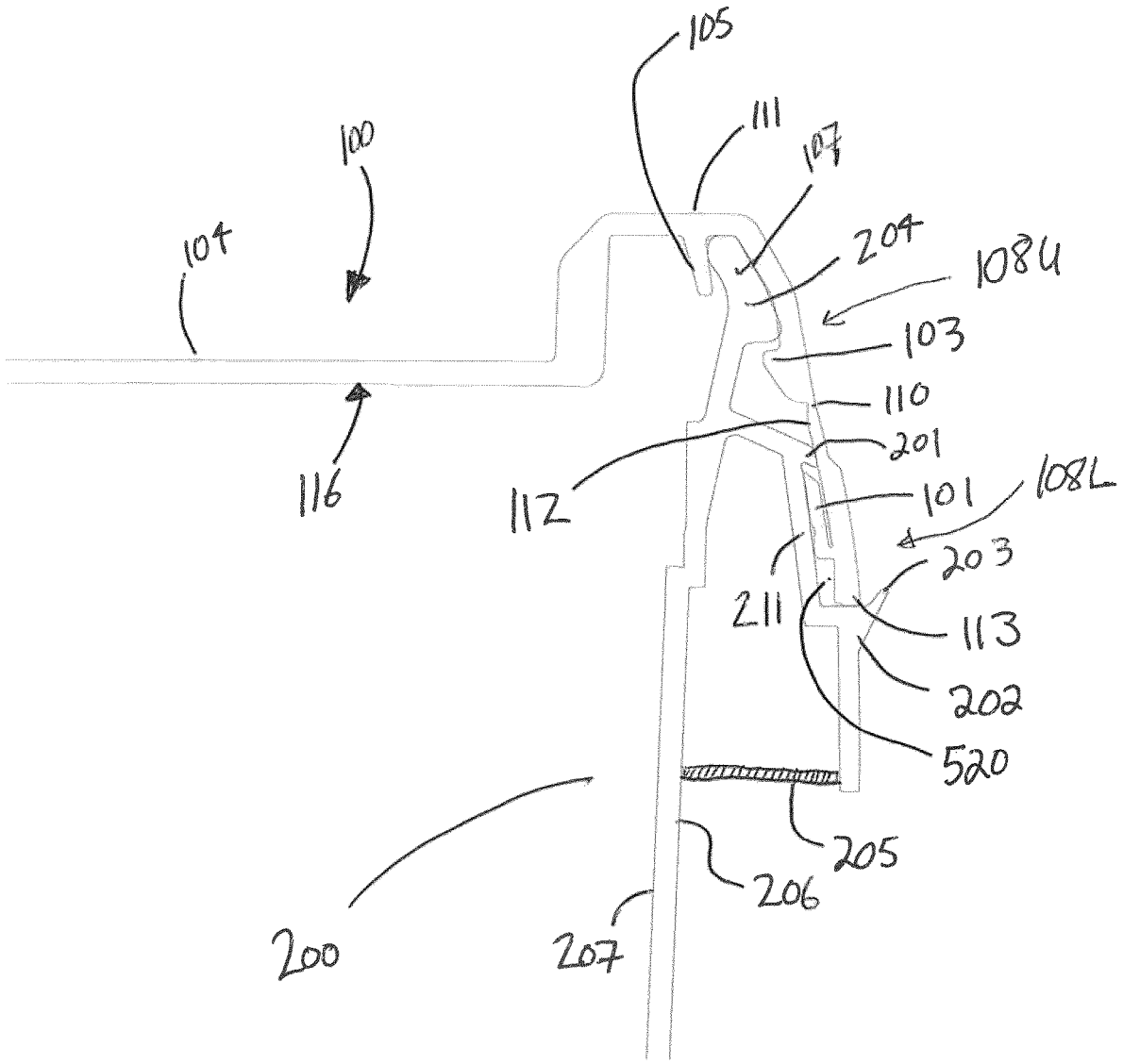
FIG. 3 shows a close up sectional view of the periphery of the lid and the container engaged to each other.
Figure 3A:
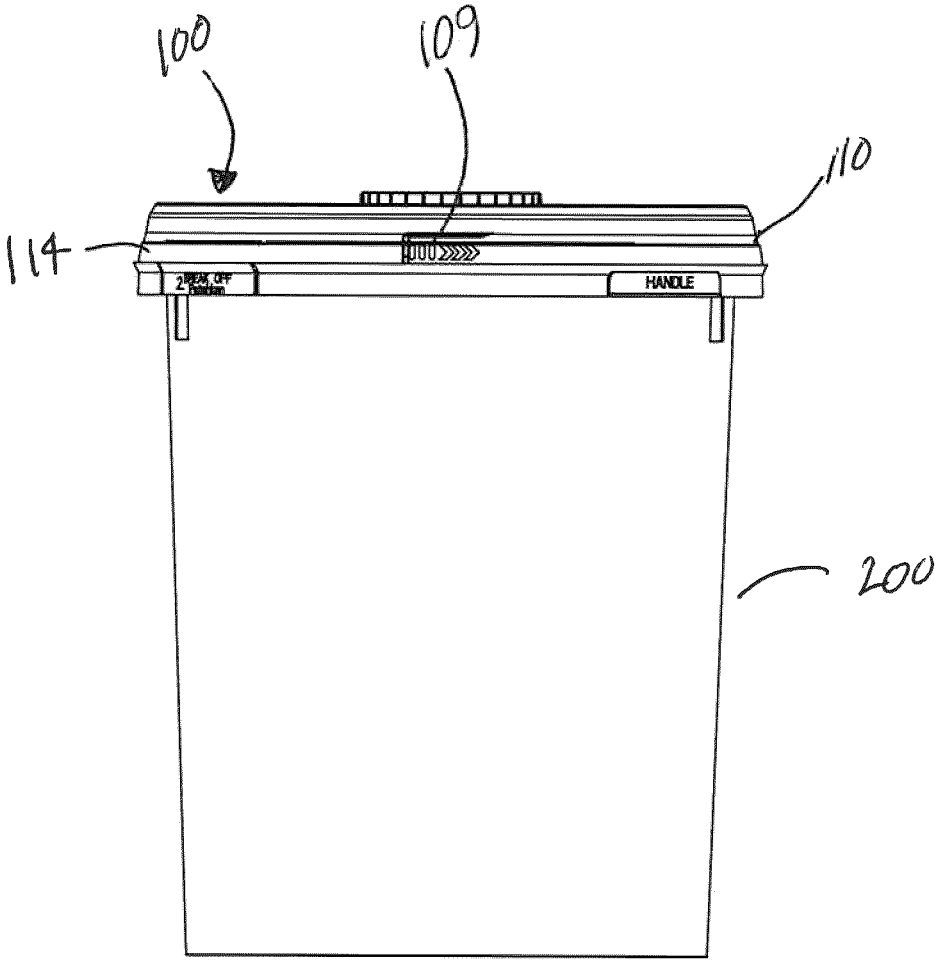
FIG. 3A shows a side elevational view of an embodiment of lid engaged upon container, with tear tab pull portion illustrated.
Figure 3B:
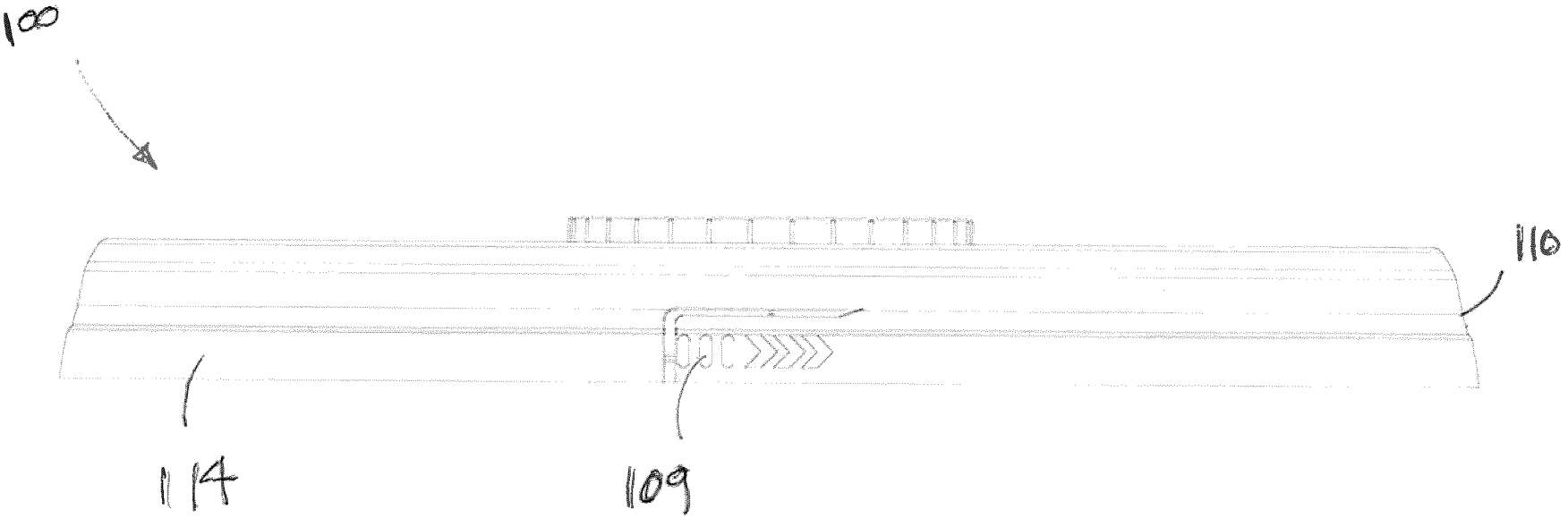
FIG. 3B is a side elevational view of the lid of FIG. 3A.

In the locked position with lid on container, the flexible teeth/tabs 101 is an upwardly biased position shown in FIG. 3. The flexible teeth/tabs 101, bias downwardly if the lid is removed from said container with tear off strip 114 still engaged and are designed to maintain this upwardly biased folded position. In an example embodiment, the flexible locking tabs (also referred to as foldable locking teeth) are spaced equally around the skirt lower portion. It should be understood that the flexible locking teeth may not in fact be spaced evenly around the lid as they may be interspersed around the circumference unevenly, and may in fact not all be sized or shaped the same as each other.

FIGS. 2-4B show sectional views of the lid 100 and container 200. In some embodiments, the lid 100 comprises a central portion 104 on the upper side. In some embodiments, the central portion 104 is recessed, separated from the periphery 111 of the lid 110 by a sidewall 115. When the lid 100 has a recessed central portion 104 at the upper side, the periphery 111 of the lid 100 is in the form of a plateau. In some embodiments, the central portion 104 is not recessed, and the periphery 111 and the central portion 104 are continuous. In some embodiments, the central portion 104 and the periphery 111 are co-planar.

The lid 100 has a skirt 108. In some embodiments, the skirt 108 extends downwardly from outer edge of the periphery 111. In some embodiments, the skirt 108 extends downwardly and outwardly from the outer edge of the periphery 111, as shown in FIG. 2. In some embodiments, the skirt 108 is set back from the outer edge of the periphery 111. In some embodiments, the skirt 108 is set back from the outer edge of the periphery 111, exposing a portion of the periphery 111 that facilitates handling of the lid 100.

In some embodiments, a ridge or inwardly disposed locking flange 103 is positioned on the interior surface 112 of the upper portion of skirt 108, the ridge 103 projecting inwardly from the interior surface 112 of the skirt 108. In some embodiments, the ridge 103 extends along the circumference of the interior surface 112 of the skirt 108 to form a closed loop. In some embodiments, the ridge 103 extends inwardly and upwardly from the interior surface 112 of the skirt 108. The ridge or inwardly disposed locking flange is adapted to engage the underside of the container upper locking flange 204 in snap fit engagement when placed upon the lid.

As shown in the drawings, flexible locking teeth/tabs 101 are provided on the interior surface 112 of the skirt 108, the teeth/tabs 101 extending inwardly from the interior surface 112 of the skirt 108. The tabs 101 are positioned below the inwardly disposed locking flange 103, i.e., the tabs 101 are between the lower edge 113 of the skirt 108 and the flange 103. In some embodiments, the tabs 101 are movable from an open position in FIG. 2 to a locked position as shown in FIG. 3. In the open position, the tabs 101 extends inwardly and downwardly from the interior surface 112 of the skirt 108. In the locked position, with lid on container, each tooth/tab 101 extends inwardly and upwardly from the interior surface 112 of the skirt 108. The movement of the tabs 101 from the open position to the locked position will be described.

In some embodiments, strengthening ribs 102 are provided on the underside 116 of the lid 100 as described before. In some embodiments, the ribs 102 extend downwardly from the underside 116 the lid 100 and outwardly toward the skirt 108. In some embodiments, the ribs 102 do not reach the skirt 108, defining a gap 107 between the ribs 102 and the skirt 108. In some embodiments, the ribs 102 extends from the underside of the central portion 104 to the underside of the periphery 111. The ribs 102 may enhance the structure of the lid 100. In some embodiments, a ridge 105 is positioned at the outer end of the ribs 102 facing the skirt 108. The ridge 105 extends downwardly from the underside of the periphery 111. The ribs 102 may strengthen the ridge 105 and vice versa. In other alternate embodiments, ribs 102 may not be present on the lid and ridge 105 may extend further down than illustrated in FIG. 3; for example ridge 105 may extend downwardly beyond the position of ridge 103.

In some embodiments, the ridge 105 extends along an exterior circumference defined by the outer ends of the ribs 102, connecting the outer ends of the ribs 102 and forming a closed loop.

Reference is now made to FIGS. 3 and 3A, which show the container system of the disclosure where the lid 100 engages the container 200.

The container 200 has a sidewall 206 that defines an opening, which the lid 100 covers. The wall 206 has an interior surface 207 and an exterior surface 208. The opening is in a shape corresponding to the shape of the skirt 108 of lid.

In some embodiments, a ridge/bead 204 is provided on the exterior surface 208 close to the upper end of the sidewall 206 of the container. In some embodiments, another ridge 201 is also provided and situated distally from the opening than the ridge 204. In some embodiments, the ridge 201 extends further from the exterior surface 208 than does the ridge 204. In some embodiments, the ridge 204 extends along the full circumference of the exterior surface 208 of the sidewall 206. In some embodiments, the ridge 201 extends along the full circumference of the exterior surface 208 of the sidewall 206.

When the lid 100 and the container 200 are engaged, a double lock configuration is formed as shown in FIG. 3.

In some embodiments, the ridge 204 and the ridge 103 press against each other in snap fit engagement, forming the first lock. In some embodiments, the surface of the ridge 204 and the surface of the ridge 103 are designed such that they cooperate to prevent each other from separating easily. For example, one surface may be concave and the other surface may be correspondingly convex so that the two surfaces snugly fit to each other. In some embodiments, the ridge 204 has a lower flat surface that extends downwardly and outwardly from the exterior surface 208, while the ridge 103 has an upper flat surface that extends upwardly and inwardly from the interior surface 112 of the skirt 108, such that the two surfaces form a locking arrangement.

In the example embodiments of the figures, when the lid is pressed onto the container, the peripheral edge of ridge 201 engages each of the teeth/tabs 101 moving them into a locked position against the container, to form the second lock. In an example embodiment the teeth sit in an upward bias position within an annular undercut 520 below the ridge 201 in the locked position. Before the lid 100 is pushed on the container 200, the teeth/tabs 101 are in the open position, extending inwardly and downwardly from the interior surface 112 of the skirt 108. During the process in which the lid 100 is put on the container 200, the end of each of the teeth/tab 101 are pushed by the ridge 201 such that the tabs 101 move from the open position to the locked position seen in FIG. 3. In the locked position, each of the tabs/teeth extend inwardly and upwardly from the interior surface 112 of the skirt 108, abutting the wall 211 of the recessed undercut portion 520 (see FIG. 4B). After the lid 100 is pushed into the locked position, the ridge 201 blocks upward movement of the tabs 101. In some embodiments, the ends of the tabs 101 engage the ridge 201. In some embodiments, the ends of the tabs 101 are separated from the ridge 201.

Figure 4A:
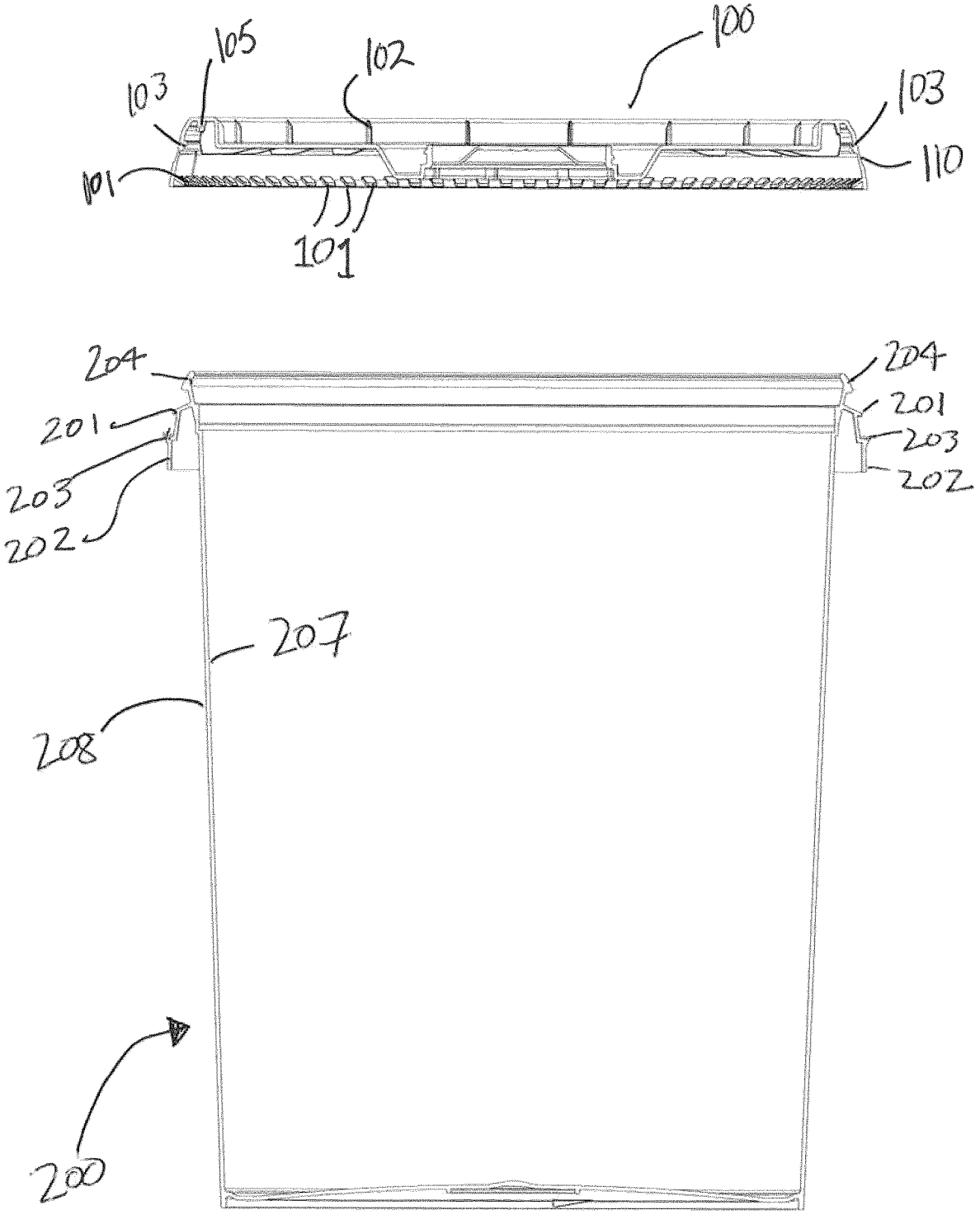
FIGS. 4A and 4B are cross sectional views of the lid and container in respective detached views.
Figure 4B:
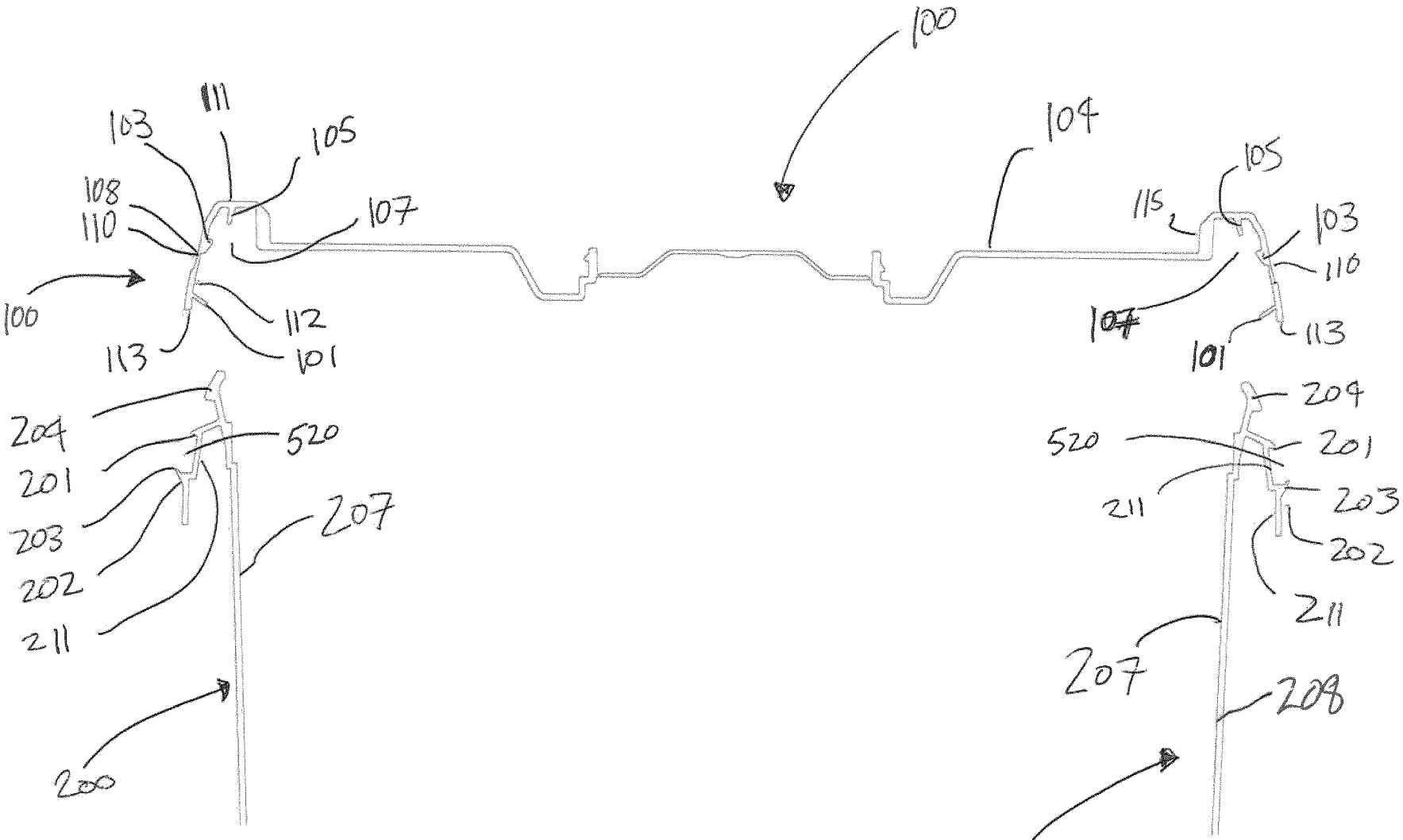
Figure 4C:
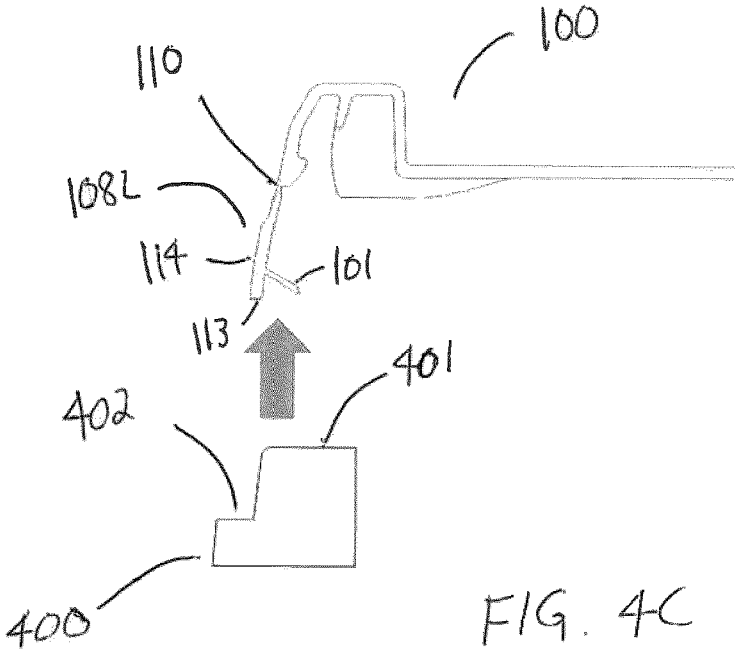
FIGS. 4C, 4D, 4E are cross sectional close up views of an embodiment of the lid with fixture engaging lid.
Figure 4D:
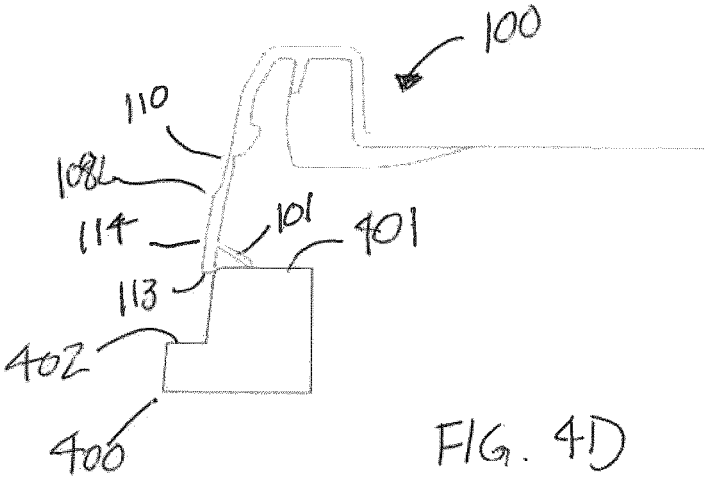
Figure 4E:
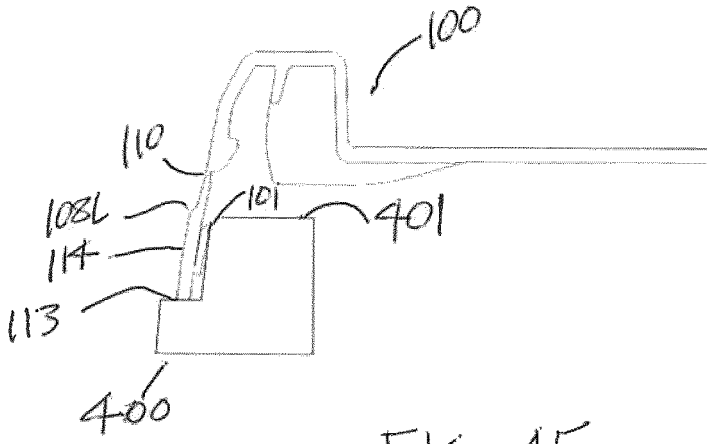

In alternate embodiments, prior to engagement on the container, the lid is positioned in a plunging station such that tabs 101 may be moved into locked position by a fixture 400, shown in FIG. 4C-4E. An embodiment of a fixture 400 is placed below the peripheral skirt 108 and positioned and shaped such that the fixture upper surface 401 engages and folds tabs 101 upwardly around the circumference of the lid during a plunging process. When in the folded position, lower surface 402 rests against the bottom edge 113 of the skirt. The fixture 400 acts to assist the folding the teeth 101 on the lid in upward direction, so the lid can snap onto the container easily during the attachment stage. The fixture 400 acts as a plunger during the lid production process as follows: the lid 100 is moved by conveyer to a fixed position adjacent the fixture 400 and the fixture 400 is driven towards the lid by pneumatic means resulting in bending the teeth upwards in folded position, shown in the sequence from FIGS. 4C to 4E. Once the teeth 101 are in the upwardly biased position, the fixture (plunger) 400 moves back away from the lid, and the lid moves to a stacking station (not shown) with the teeth 101 in ideal position, namely upwardly biased (such as shown in FIG. 4E). The next lid 100 moves in to this fixed position to be plunged by the fixture 400 and move its teeth 101 to the upwardly biases position. In summary, the fixture/plunger acts during the production process to ensure the teeth 101 are folded in upward position prior to insertion on each container. Although an embodiment of fixture 400 is shown, it may be shaped accordingly to the circumference and specifications of the lid, which may be circular, square, rectangular or other conceivable shape.

In some embodiments, one or more rib 205 is provided between the ridge 201 and the sidewall 206 of the container. The rib 205 extends between the exterior surface 208 of the sidewall and the ridge 201. In some embodiments, the rib 205 supports the ridge 201. In some embodiments, the rib 205 prevents the ridge 201 from being pushed inwardly to release the tabs 101.

In some embodiments, the upper portion of the sidewall 206 is received in the gap 107 between the ribs 102 and the skirt 108. In some embodiments, the ridge 105 pushes the sidewall 206 outwardly. In some embodiments, the ribs 102 support the sidewall 206 outwardly. In some embodiments, the locking between the lid 100 and the container 200 is enhanced when the sidewall 206 is pushed outwardly.

In some embodiments, a ridge 202 is provided extending from the container wall that extends away from the exterior surface 208 of the sidewall 206. The ridge 202 is positioned below the ridge 201 and tab 101 when in locked position. Ridge 202 extends adjacent underneath the bottom edge of the lid skirt 113 when said lid is on the container. When the lid 100 and the container 200 are engaged, the ridge 202 is positioned immediately below the lower edge 113 of the skirt 108, such that it is difficult to slip an object between the lid 100 and the container 200 to pry open the lid 100. In some embodiments, the lower edge 113 of the skirt 108 is in contact with the ridge 202.

In the embodiment shown, the side wall 211 of the undercut portion 520 of the container connects the ridge 201 and the ridge 202. In some embodiments, the sidewall 211 extends downwardly and outwardly from the ridge 201 such that the ridge 202 is positioned further away from the sidewall 206 than the ridge 201. The sidewall 211 encircles the upper perimeter of sidewall 206.

In some embodiments, the ridge 202 of the side wall has an upwardly extending peripheral free end 203. The free end 203 may be in contact with the lower edge 113 of the skirt 108 when the lid 100 and the container 200 are engaged. The free end 203 is positioned immediately above and peripherally to the lower edge 113 of the skirt 108. The free end 203 extends upwardly and outwardly beyond the lower edge 113 of the skirt 108 such that the lower edge 113 of the skirt 108 is at least partially enclosed by the ridge 202 and free end 203 and the sidewall 206 or 211 of the container 200. In alternate embodiments, to add further tamper protection, free end 203 could extend upwardly only, rather than outwardly. These configurations may make it difficult to insert an object between the lid 100 and the container 200 to pry the lid 100 off the container 200.

In some embodiments, a support rib 205 extends downwardly along the sidewall 206 of the container and terminates at a position that is farther away from the lid 100 than the ridge 202 such that the rib 205 supports the ridge 202. Such a configuration may enhance the structure and makes it more difficult to push the ridge 202 toward the sidewall 206. In some embodiments, suitable alternative structure is provided to support the ridge 202.

In some embodiments, the lid 100 is made of plastic. In some embodiments, the plastic is injection molded to form the lid 100. In some embodiments, the lid is made of metal, plastic, paper, or a combination thereof by any suitable means known in the field.

In some embodiments, the container 200 is made of plastic. In some embodiments, the plastic is injection molded to form the container 200. In some embodiments, the container is made of metal, plastic, paper, or a combination thereof by any suitable means known in the field.

When the lid 100 engages the container 200, it may be difficult or impossible to remove the lid 100 in the normal usage of the container as described earlier. In some embodiments, a tearable portion 114 is provided on the lid 100 as described above. By tearing the tearable portion 114 along the weakened area, the circumference of the skirt 108 from which the tabs 101 extend is no longer a complete circumference such that the remaining portion of the circumference can be pried outwardly to facilitate the removal of the lid 100.

In some embodiments, the weakened area extends along the full circumference of the lid such that when the tearable portion is removed all the tabs 101 are removed, resulting in the removal of the lock formed by the tabs 101 and container. The skirt 108 may then be moved outwardly to disengage the lock between the skirt 108 and the sidewall 206.

In some embodiments, the tearable portion 114 serves as an evidence of tampering. When a user receives the container system 10 and the tearable portion 114 has been torn, the user would know that the container with attached lid has been tampered with.

The teeth/tabs 101 may be connected to the skirt 108 by frangible lines such that the tab may be biased into the upward locked position, however if the lid 100 is forcibly removed from the container 200 without the removal of the tearable portion 114, the tabs 101 are forced downwardly, showing that the container lid upon the container has been tampered with.

In fact, the positioning of the tabs 101 in the undercut position 520, with each said tab 101 individually abutting the sidewall, immediately below the ridge 201, creates a strong locking force by each tab. To pull off the lid without the removal of the tearable portion will result in the tabs 101 being forceably pressed downwardly by engagement with ridge 201 at the point of removal, causing a downward fold of the tabs. The embodiments of the present disclosure described above are intended to be examples only. The present disclosure may be embodied in other specific forms. Alterations, modifications and variations to the disclosure may be made without departing from the intended scope of the present disclosure. While the system, devices and processes disclosed and shown herein may comprise a specific number of elements/components, the systems, devices and assemblies could be modified to include addition or fewer of such elements/components. For example, while any of the elements/components disclosed may be referenced as being singular, the embodiments disclosed herein could be modified to include a plurality of such elements/components.

While circular containers are shown, the herein invention may be used with square or rectangular containers or other possible shaped. Selected features from one or more of the above-described embodiments may be combined to create alternative embodiments not explicitly described. All values and sub-ranges within disclosed ranges are also disclosed. The subject matter described herein intends to cover and embrace all suitable changes in technology. All references mentioned are hereby incorporated by reference in their entirety.

The invention claimed is:

1. A lid for a container, said container having an peripheral side wall with an upper rim, said rim including an upper peripheral, annular outwardly extending locking flange and a lower peripheral, annular outwardly extending locking flange, each of the upper peripheral annular outwardly extending locking flange and the lower peripheral annular outwardly extending locking flange, independently, having an underside for locking engagement with the container lid, the lid comprising:

a central portion; and a peripheral downwardly extending annular skirt configured to overlie and engage at least a portion of the container wall;

wherein:

the downwardly extending annular skirt includes an annular groove dividing said skirt into a skirt upper portion, and a skirt lower portion;

the skirt upper portion includes an inwardly extending upper lid locking flange that projects inwardly from an inner surface of the skirt upper portion and extends continuously about an inner circumference of the upper skirt portion, the upper lid locking flange configured for engaging the underside of the upper peripheral annular outwardly extending locking flange of the container;

the skirt lower portion includes a plurality of inwardly disposed flexible locking tabs disposed in spaced apart relationship about an inner circumference defined by an inner surface of the skirt lower portion, wherein each one of the plurality of inwardly disposed flexible locking tabs, independently, extends inwardly from the inner surface of the skirt lower portion and is adapted to engage a portion of the container wall when said lid is positioned on said container;

each one of the plurality of inwardly disposed flexible locking tabs, independently, is moveable between at least: (i) a first position wherein each one of the plurality of flexible locking tabs, independently, extends downwardly and away from the inner surface of the skirt lower portion, and (ii) a second position wherein each one of the plurality of flexible locking tabs, independently, extends upwardly and is disposed adjacent to the inner surface of the lower skirt portion;

and while the lid is positioned on said container such that the container is disposed in a closed condition, the inwardly extending upper lid locking flange, the plurality of inwardly disposed flexible locking tabs, the upper peripheral annular outwardly extending locking flange, and the lower peripheral annular outwardly extending locking flange are co-operatively configured such that:

(i) a first lid-locking configuration is established by engagement between the inwardly extending upper lid locking flange and the underside of the upper peripheral annular outwardly extending locking flange, the first lid-locking configuration extending continuously about an engagement interface defined between the skirt upper portion and the container; and (ii) a second lid-locking configuration is established by engagement between each one of the plurality of flexible locking tabs, independently, and the underside of the lower peripheral annular outwardly extending locking flange such that a plurality of discrete engagement interfaces are established between the skirt lower portion and the container;

and in response to application of an upwards force to the lid, relative to the container, while the lid is disposed on the container, removal of the lid from the container is resisted by at least: (a) at least some of the plurality of flexible locking tabs abutting the underside of the lower peripheral annular outwardly extending locking flange, and (b) the inwardly extending upper lid locking flange abutting and the underside of the upper peripheral annular outwardly extending locking flange.

2. The lid of claim 1 wherein the plurality of flexible locking tabs are a series of upwardly foldable locking tabs each defining an independent point of contact when the lid and the container are connected together such that a plurality of independent interference forces are generated in response to application of an upwards force to the lid, relative to the container.

3. The lid of claim 1 wherein the container includes a radial outwardly facing annular undercut positioned below said lower peripheral annular outwardly disposed locking flange such that as said lid is pressed downwardly upon the container, each one of the plurality of flexible locking tabs, independently, is folded upwardly and inwardly in response to downwards displacement of the lid, relative to the container, over the lower peripheral annular outwardly disposed locking flange to sit within said annular undercut.

4. A lid and container system comprising the lid and container of claim 3.

5. The lid of claimed in claim 1 wherein the skirt lower portion includes tear-off strip portion having a lower peripheral edge, and wherein the tear-off strip portion is formed by a reduced thickness portion defining a circumferential reduced thickness portion located below the skirt upper portion, facilitating removal of the tear off strip.

6. The lid of claim 5 wherein said reduced thickness portion is said annular groove.

7. The lid of claim 1 wherein each one of said plurality of flexible tabs, independently, is forced to be folded downwardly in response to impingement against the lower peripheral annular outwardly extending locking flange effectuated in response to upward movement of the lid relative to the container while the tear off strip still engaged.

8. The lid of claim 1 wherein the plurality of flexible locking tabs are spaced apart equidistantly around the inner surface of the skirt lower portion.

9. The lid of claim 8 wherein the plurality of flexible locking tables includes between 10-120 equidistantly spaced flexible locking tabs around the inner surface of the lower skirt portion.

10. The lid of claim 1 wherein the lid is formed via a molding process with said plurality of flexible locking tabs positioned in the upward and inwardly disposed position.

11. The lid of claim 10 wherein a fixture acts upon the lid during production process to bias the plurality of flexible locking tabs in the upward and inwardly disposed position.

12. The lid of claim 1 wherein the lid and container each, independently, comprise plastic.

13. The lid of claim 1 wherein the peripheral downwardly extending annular skirt terminates at a lower edge configured for abutting engagement with a radially outwardly extending sidewall ridge protective surface defined by the container, such that while the lid is placed on the container, the lower edge of the annular skirt abuts the radially outwardly extending sidewall ridge protective surface so as to inhibit insertion of an implement between the skirt and container to pry the lid off the container.

14. The lid of claim 13 wherein the radially outwardly extending sidewall ridge protective surface of the container includes an upwardly extending peripheral free end such that while the lid is positioned on the container, the lower edge of the annular skirt is disposed behind the upwardly extending peripheral free end thereby further inhibiting the insertion of an implement between the lower edge of the annular skirt and the radially outwardly extending sidewall ridge protective surface of the container.

15. The lid of claim 14 wherein the container includes support ribs that each, independently, extend between the peripheral sidewall of the container and an annular outer portion of the container that extends about the container in spaced apart relationship from the sidewall below the radially outwardly extending sidewall ridge protective surface for: (i) providing structural support to the peripheral sidewall of the container and (ii) preventing inward deformation of the annular outer portion, relative to the peripheral sidewall of the container for enhancing the engagement between the lid and the container while the lid is positioned on the container.

16. The lid of claim 1 wherein: while the lid is positioned on the container such that the container is disposed in a closed condition, the engagement between the inwardly extending upper lid locking flange and the lid locking engagement surface of the upper peripheral annular outwardly extending locking flange is a snap fit engagement.

* * * * *